United States Patent [19]

Chang

[11] Patent Number: 4,914,753

[45] Date of Patent: Apr. 10, 1990

[54] ATHLETIC KNEE PAD

[76] Inventor: Cheng-Shung Chang, #43, Alley 18, Lane 131, Tahu Street, Taipei, Taiwan

[21] Appl. No.: 217,007

[22] Filed: Jul. 8, 1988

[51] Int. Cl.[4] ..... A41D 13/06

[52] U.S. Cl. ..... 2/24; 2/59; 2/268

[58] Field of Search ..... 2/16, 24, 59, 268

[56] References Cited

U.S. PATENT DOCUMENTS

| | | | |
|---|---|---|---|
| 1,081,245 | 12/1913 | McCall | 2/24 |
| 2,534,888 | 12/1950 | Vold | 2/24 |
| 2,552,177 | 5/1951 | Hart | 2/24 |
| 3,463,143 | 8/1969 | Stubbs | 2/24 X |
| 4,193,134 | 3/1980 | Hanrahan et al. | 2/16 |
| 4,198,708 | 4/1980 | Fugere et al. | 2/16 |
| 4,229,833 | 10/1980 | Cox et al. | 2/16 O R |
| 4,250,578 | 2/1981 | Barlow | 2/24 O R |
| 4,333,181 | 6/1982 | Corriero | 2/24 O R |
| 4,484,361 | 11/1984 | Leighton et al. | 2/16 X |
| 4,494,247 | 1/1985 | Kelly | 2/16 X |
| 4,599,747 | 7/1986 | Robinson | 2/16 O R |
| 4,756,026 | 7/1988 | Pierce, Jr. | 2/24 X |

*Primary Examiner*—Steven N. Meyers
*Assistant Examiner*—Jeanette E. Chapman
*Attorney, Agent, or Firm*—Lyon & Lyon

[57] ABSTRACT

A protective pad, such as an athletic knee pad, which is worn about the knee to provide protection to a joint such as the knee cap, in which the pad has a padded front section, an elastic rear section, an adjustable upper elastic sleeve, and an elastic lower sleeve of a smaller diameter than the main body of the pad.

6 Claims, 1 Drawing Sheet

ATHLETIC KNEE PAD

FIELD OF THE INVENTION

This invention relates to the field of athletic equipment and in particular to the field of knee pads.

BACKGROUND OF INVENTION

It has long been known to use pads to protect the joints such as the knee or elbow from bruises or other injury during athletic competition. Participants in sports which are played on hardwood surfaces, such as basketball and volleyball, have utilized knee pads to protect their knees from injury caused by the sudden and sometimes not so infrequent contact with the floor. Prior knee pad devices have generally consisted of a padded front portion and an elastic rear portion. These prior devices were not adjustable, the result being that these earlier types of knee pads were uncomfortable and not readily interchangeable between users of different sizes. To accommodate the fact that different users would be of different sizes the manufacturers of these prior knee pads had to produce a complete line of different size products.

The present invention provides for an athletic knee pad which is adjustable and therefore more comfortable to wear and one in which one size knee pad fits wearers of differing sizes.

SUMMARY OF THE INVENTION

The present invention is a knee pad which is intended to provide protection to the knee during athletic competition such as basketball or volleyball. The invention is comprised of a padded front section or portion which fits over the knee cap and provides protection from impact on the front of the knee. The rear portion of the knee pad is constructed from an elastic material so that the knee pad will fit snugly about the knee when the pad is pulled onto the wearers leg and up about the knee. An elastic band or sleeve is located about the bottom or calf-end of the knee pad to help secure the pad in place. An adjustable elastic sleeve is fastened about the upper portion or thigh-end of the knee pad. This upper adjustable sleeve allows the wearer more properly adjust the knee pad to his or her knee. The upper adjustable sleeve is formed by an elastic loop which is wrapped around the lower portion of the wearers thigh just above the knee. The loop is fastened by means of a hook and loop closure means to form an upper elastic sleeve holding the knee pad in place during its usage. The adjustable upper sleeve allows the knee pad to be worn comfortably by individuals of differing sizes.

DETAILED DESCRIPTION OF THE PREFERRED EMBODIMENT

Figure 1:
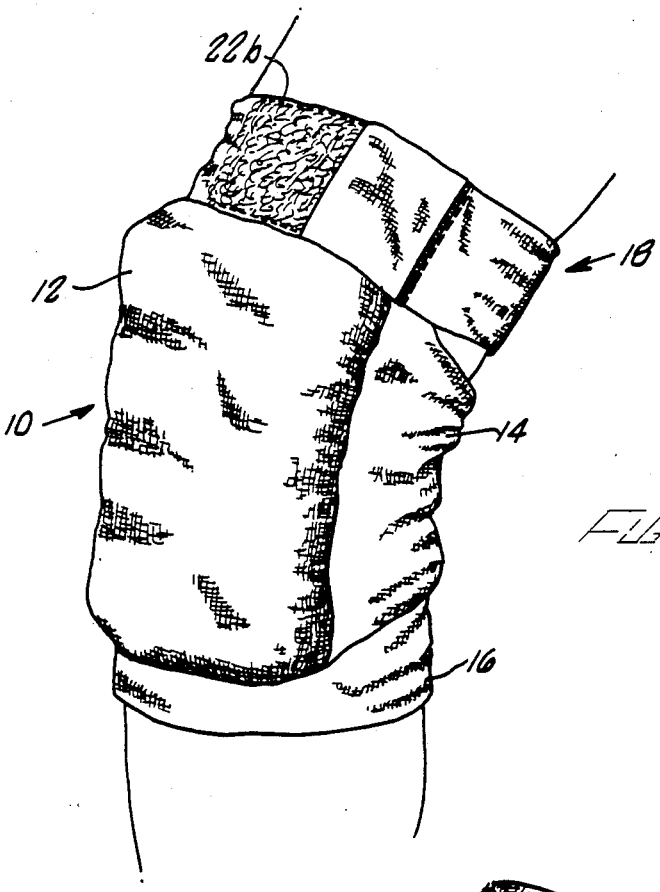
FIG. 1 is a side perspective view showing the invention as actually worn about the knee.
Figure 2:
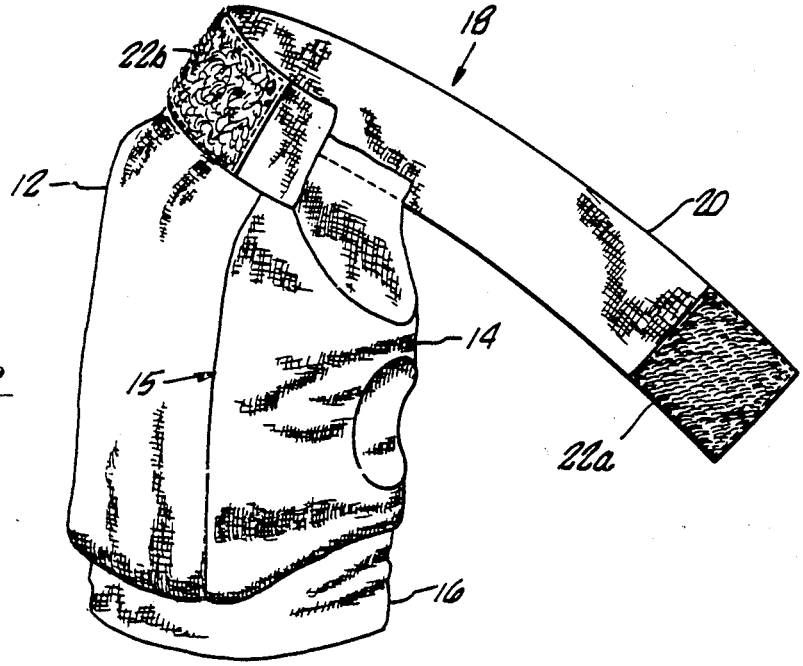
FIG. 2 is a side rear view showing the various components of the invention when the invention is not being worn.

The subject invention is illustrated in FIGS. 1 and 2. The knee pad 10 is worn about the knee to help prevent injury to the knee during activities such as basketball and volleyball. These sports are frequently played on hard surfaces such as hardwood floors or asphalt play grounds.

The knee pad 10 is comprised of a front padded section 12, a rear elastic section 14, a lower elastic sleeve 16 and an upper adjustable elastic sleeve 18. As shown in FIG. 2 the front padded section 12 is connected to the rear elastic section 14 to form an the main body section 15 of the knee pad 10. This main body section 15 is in the form of an elongated sleeve which can be pulled onto the leg and aligned over the knee cap with the front padded section 12 covering the knee cap. The padded front section 12 and the elastic rear section 14 are known in the art and can be of any suitable construction known to one of ordinary skill in the art.

As shown in FIG. 1, the invention is intended to be worn over the knee cap to provide a measure of protection and help reduce the chance of injury resulting from a blow to the knee cap. To hold the knee pad 10 in place during use the pad is equipped with a lower or calf-end elastic sleeve 16 and an upper or thigh-end adjustable elastic sleeve 18. The lower elastic sleeve 16 is of a smaller diameter than the elongated sleeve formed by the main body section 15 of the knee pad (the front padded section and the rear elastic section). This lower elastic sleeve 16 is permanently fastened to the main body so as to form an integral unit. The smaller diameter of the lower elastic sleeve 16 results in the sleeve providing a tight fit thereby helping to hold the knee pad in place while it is being worn.

The upper adjustable sleeve 18 is shown in FIG. 2. The sleeve consists of a strap of elastic material 20 which is partly fastened by sewing or other suitable means to the top of the knee pad. A hook and loop fastening means **22*a*, 22*b* is attached to the strap 20 as shown in FIG. 2. When being worn the strap 20 is wrapped about the back of the knee or lower thigh of the wearer and the free end of the strap is fastened to the secured end of the strap by means of the hook and loop fastening means 22*a*, 22*b* as shown in FIG. 1. As can readily be seen the upper strap 20 is adjustable and can be easily worn by individuals of differing leg sizes. Additionally, due to the elasticity of the strap material and the hook and loop fastening means the individual wearer can adjust the fastening force of the upper sleeve 18 which is formed by strap 20 to fit his or her particular preference. This ability to adjust the upper sleeve 18 allows for the lower elastic sleeve 16** to be constructed to fit a little more loosely than on prior athletic knee pads. This results in the instant invention being more comfortable to wear than prior devices. In alternate embodiments of the invention the pad can be of a size and known configuration to fit other parts of the body such as the elbow.

Having thus described one embodiment of my invention in detail, it is to be understood that numerous equivalents and alterations which do not depart from the invention will be apparent to those skilled in the art, given the teaching herein. Thus my invention is not limited to the above description, but is to be encompassed by the full scope of the appended claims.

What is claimed:

1. An athletic knee pad comprised of:

a padded front section;

an elastic rear section wherein said padded front section and elastic rear section are joined together to form an elongated sleeve;

an elastic lower sleeve connected to the bottom of the elongated sleeve, said lower elastic sleeve being of a smaller diameter than the elongated sleeve; and a wearer adjustable elastic upper sleeve connected to the top of the elongated sleeve.

2. The athletic knee pad of claim 1 wherein the adjustable elastic upper sleeve is comprised of an elastic strap one end of which is connected to the knee pad, said elastic strap including fastening means for fastening the free unconnected end of the strap to the end of the strap connected to the knee pad.

3. An athletic knee pad comprised of:

a padded front section;

an elastic rear section wherein said padded front section and elastic rear section are joined together to form an elongated sleeve;

an elastic lower sleeve connected to the bottom of the elongated sleeve, said lower elastic sleeve being of a smaller diameter than the elongated sleeve; and an elastic strap, one end of which is connected to the knee pad, said elastic strap including fastening means for fastening the free unconnected end of the strap to the end of the strap connected to the knee pad.

4. A protective pad comprised of:

a padded front section;

an elastic rear section wherein said padded front section and elastic rear section are joined together to form an elongated sleeve;

an elastic lower sleeve connected to the bottom of the elongated sleeve, said lower elastic sleeve being of a smaller diameter than the elongated sleeve; and a wearer adjustable elastic upper sleeve connected to the top of the elongated sleeve.

5. The protective pad of claim 4 wherein the adjustable elastic upper sleeve i comprised of an elastic strap one end of which is connected to the pad, said elastic strap including fastening means for fastening the free unconnected end of the strap to the end of the strap connected to the pad.

6. A protective pad comprised of:

a padded front section;

an elastic rear section wherein said padded front section and elastic rear section are joined together to form an elongated sleeve;

an elastic lower sleeve connected to the bottom of the elongated sleeve, said lower elastic sleeve being of a smaller diameter than the elongated sleeve; and an elastic strap, one end of which is connected to the pad, said elastic strap including fastening means for fastening the free unconnected end of the strap to the end of the strap connected to the pad.

* * * * *